US008556345B2

(12) United States Patent
Huang

(10) Patent No.: US 8,556,345 B2
(45) Date of Patent: Oct. 15, 2013

(54) CHAIR HAVING ANGLE AND TENSION ADJUSTING FUNCTIONS

(75) Inventor: Chih-Yang Huang, Hemei Township, Changhua County (TW)

(73) Assignee: Sheng Jia Sheng Co., Ltd., Changhua County (TW)

( * ) Notice: Subject to any disclaimer, the term of this patent is extended or adjusted under 35 U.S.C. 154(b) by 359 days.

(21) Appl. No.: 13/046,830

(22) Filed: Mar. 14, 2011

(65) Prior Publication Data

US 2012/0235456 A1 Sep. 20, 2012

(51) Int. Cl.
*A47C 1/032* (2006.01)

(52) U.S. Cl.
USPC ..... 297/300.5; 297/303.4

(58) Field of Classification Search
USPC ..... 297/300.2, 300.5, 301.1, 301.4, 303.4
See application file for complete search history.

(56) References Cited

U.S. PATENT DOCUMENTS 4,687,250 A * 8/1987 Esche ..... 297/300.5
4,744,600 A * 5/1988 Inoue ..... 297/300.5
4,988,145 A * 1/1991 Engel ..... 297/300.4
5,080,318 A * 1/1992 Takamatsu et al. ..... 248/598
5,150,948 A * 9/1992 Volkle ..... 297/300.5
5,354,120 A * 10/1994 Volkle ..... 297/300.1
5,601,338 A * 2/1997 Wahls ..... 297/313
6,053,574 A * 4/2000 Opsvik ..... 297/337
8,025,335 B2 * 9/2011 Gehner ..... 297/300.2
8,146,990 B2 * 4/2012 Bock ..... 297/300.4
2004/0195883 A1 * 10/2004 Vrijlandt et al. ..... 297/302.4

* cited by examiner

*Primary Examiner* — Peter Brown
(74) *Attorney, Agent, or Firm* — Alan Kamrath; Kamrath IP Lawfirm, P.A.

(57) ABSTRACT

A chair includes a chair body, a connecting member, a back portion, and a restoring device. The chair body includes a base having a receiving chamber. The restoring device includes a threaded adjusting sleeve rotatably mounted in the receiving chamber, a threaded rod screwed into the adjusting sleeve, a pull cord having a first end mounted on the connecting member and a second end mounted on the threaded rod, and an elastic member biased between the base and the adjusting sleeve. Thus, when the back portion is pressed, the connecting member is driven to pivot about the chair body so that the back portion is moved to adjust its inclined angle. In addition, the elastic member provides a damping force to damp a further movement of the back portion to limit the inclined angle of the back portion.

18 Claims, 14 Drawing Sheets

CHAIR HAVING ANGLE AND TENSION ADJUSTING FUNCTIONS

BACKGROUND OF THE INVENTION

1. Field of the Invention

The present invention relates to a chair and, more particularly, to an office chair.

2. Description of the Related Art

A conventional chair comprises a seat, an elastic plate having a lower end mounted on the seat, a back mounted the upper end of the elastic plate, and a stand mounted on the bottom of the seat. When in use, the elastic plate is located between the seat and the back so that when the back is pressed by a user's weight, the elastic plate is deformed in an elastic manner to recline the back relative to the seat. Thus, when the back is pressed by the user's weight, the back is moved rearward and downward to an inclined position by the deformation of the elastic plate so as to provide a comfortable sensation to the user. However, the elastic plate easily produces an elastic fatigue during a long-term utilization, so that the inclined angle of the back is too large when the user presses the back, thereby causing an uncomfortable sensation to the user when the elastic plate is inoperative.

BRIEF SUMMARY OF THE INVENTION

In accordance with the present invention, there is provided a chair, comprising a chair body, at least one connecting member pivotally connected with the chair body, at least one back portion connected with the connecting member to press and pivot the connecting member outward relative to the chair body, and at least one restoring device mounted between the connecting member and the chair body to pull the connecting member toward the chair body.

The chair body includes a base. The base of the chair body is provided with at least one receiving chamber to receive the restoring device. The restoring device includes a threaded adjusting sleeve rotatably mounted in the receiving chamber of the base, a threaded rod screwed into the adjusting sleeve, a pull cord having a first end mounted on the connecting member to move in concert with the connecting member and a second end mounted on the threaded rod to pull the threaded rod and the adjusting sleeve toward the connecting member, and an elastic member mounted on the threaded rod and biased between the base of the chair body and the adjusting sleeve to push the threaded rod and the adjusting sleeve outward relative to the connecting member.

The primary objective of the present invention is to provide a chair having angle and tension adjusting functions.

According to the primary advantage of the present invention, when the back portion is pressed by a user's weight, the connecting member is driven by the back portion and is pivoted about the support shaft of the chair body so that the back portion is moved rearward and downward to adjust the inclined angle of the back portion so as to provide a comfortable sensation to the user.

According to another advantage of the present invention, when the connecting member is pivoted, the elastic member provides a damping force to damp and stop a further movement of the back portion so as to limit the inclined angle of the back portion.

According to a further advantage of the present invention, when the force applied on the back portion disappears, the pull cord is driven by the restoring force of the elastic member so that the connecting member is moved forward and upward to return the back portion to the original position.

According to a further advantage of the present invention, when the elastic member produces an elastic fatigue during a long-term utilization, the adjusting sleeve can be rotated to compress the elastic member so as to increase the tension of the elastic member.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
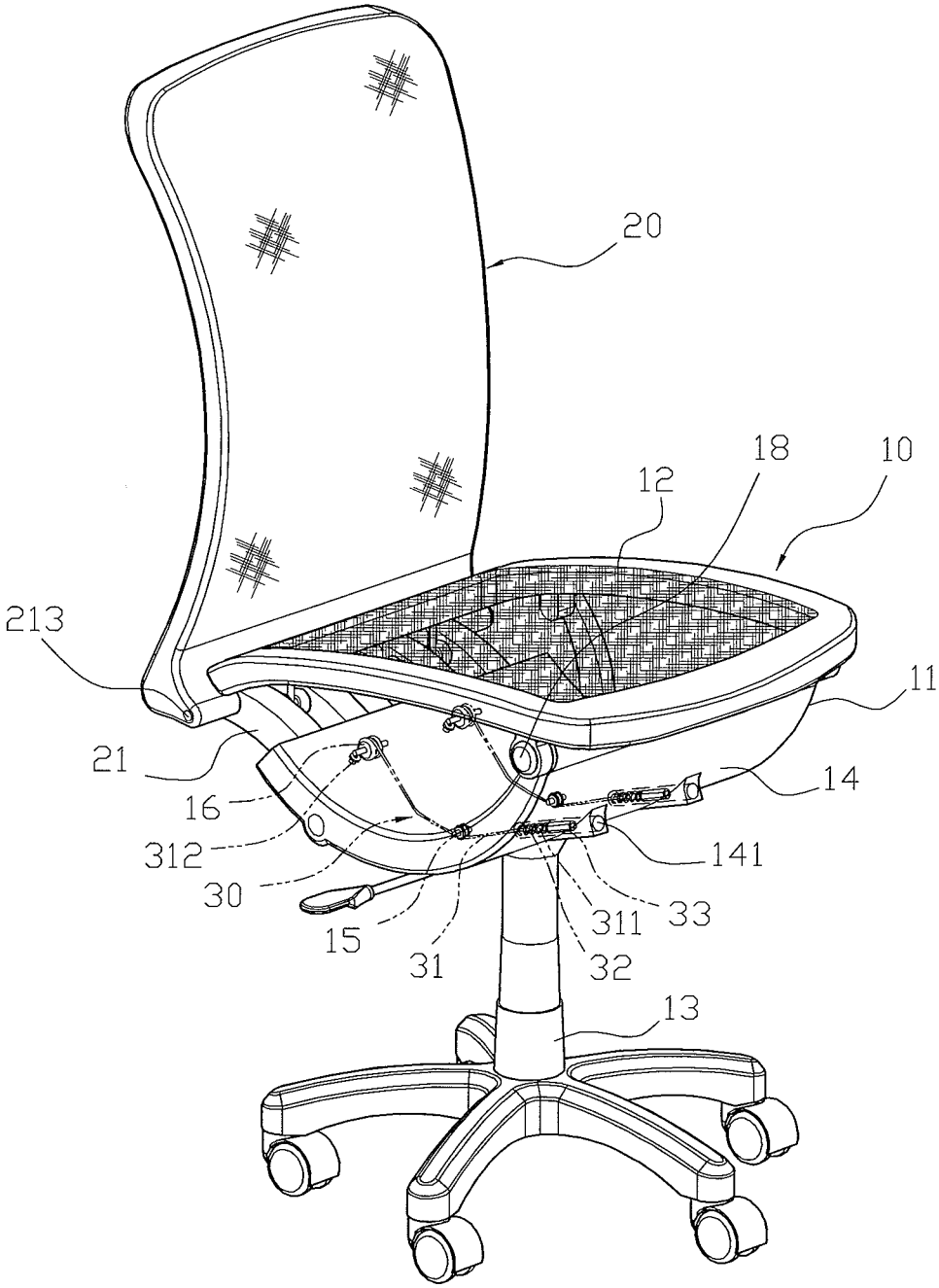
FIG. 1 is a perspective view of a chair in accordance with the preferred embodiment of the present invention.
Figure 2:
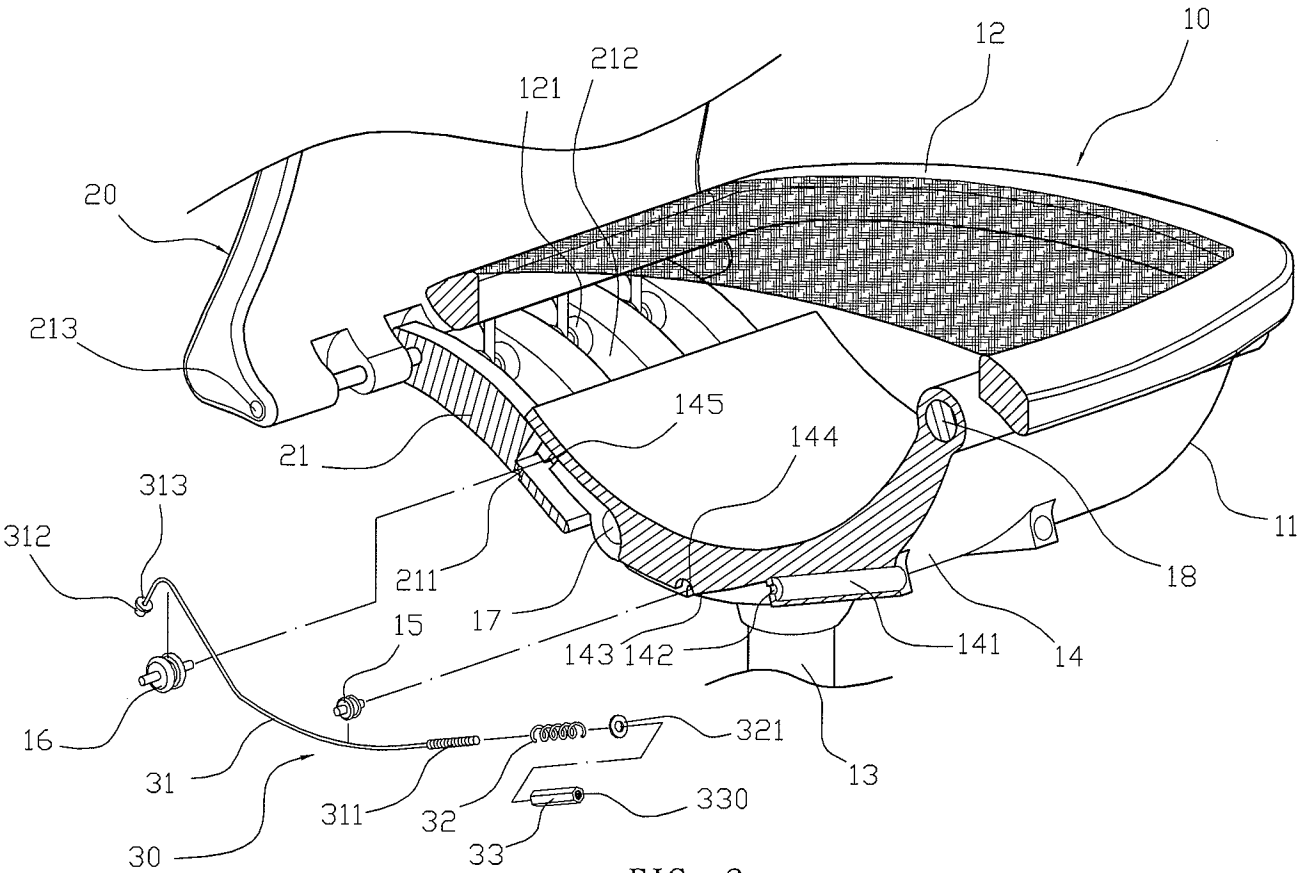
FIG. 2 is a partially exploded perspective cross-sectional view of the chair as shown in FIG. 1.
Figure 3:
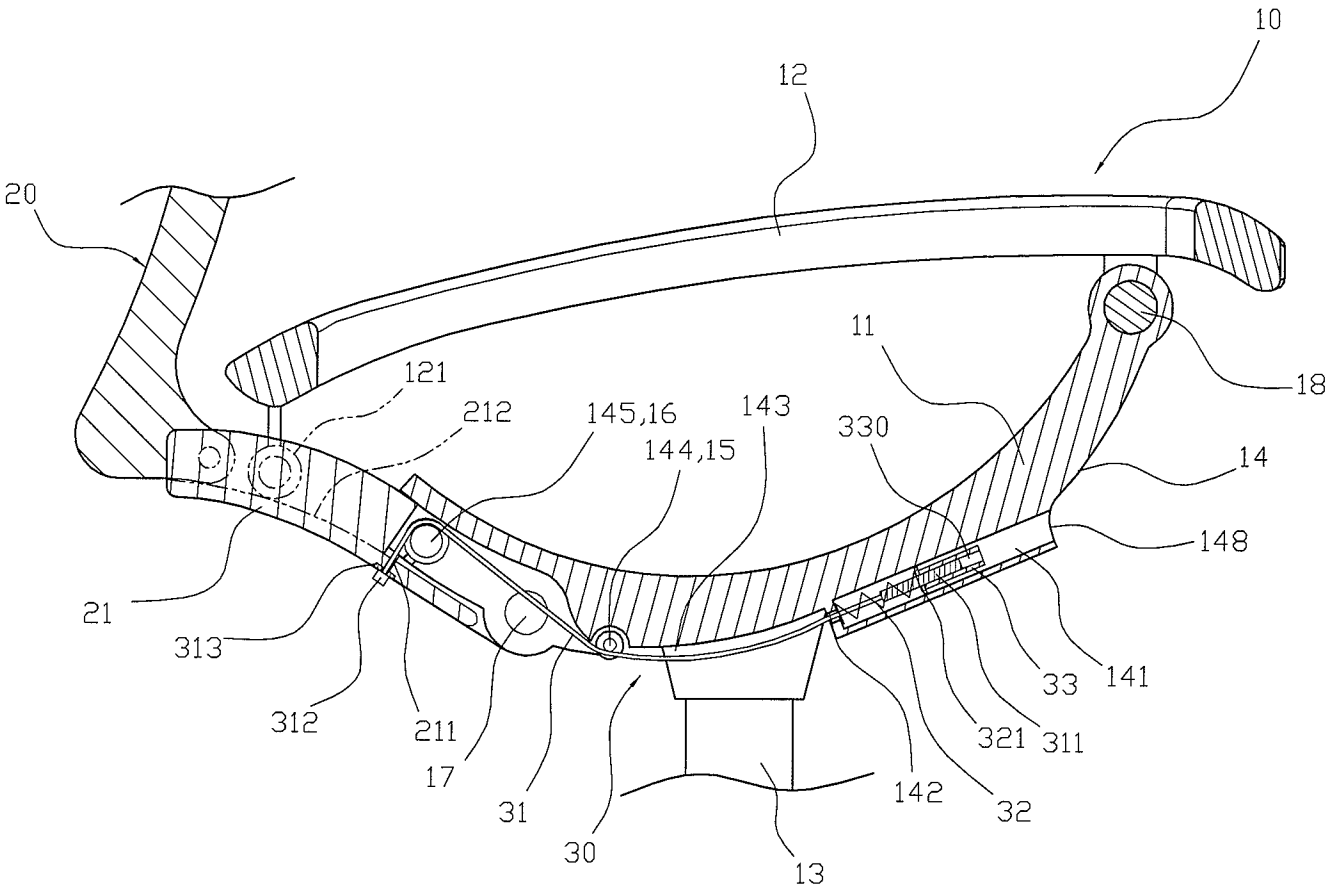
FIG. 3 is a side cross-sectional view of the chair as shown in FIG. 2.

Referring to the drawings and initially to FIGS. 1-3, a chair in accordance with the preferred embodiment of the present invention comprises a chair body 10, at least one connecting member 21 pivotally connected with the chair body 10, at least one back portion 20 connected with the connecting member 21 to press and pivot the connecting member 21 outward relative to the chair body 10, and at least one restoring device 30 mounted between the connecting member 21 and the chair body 10 to pull the connecting member 21 toward the chair body 10.

The chair body 10 includes a base 11, a support shaft 17 mounted on the base 11 and connected with the connecting member 21, a seat portion 12 mounted on the base 11, and a stand 13 mounted on the base 11. The base 11 of the chair body 10 is provided with at least one receiving chamber 141 to receive the restoring device 30. The receiving chamber 141 of the base 11 has a side provided with a through hole 142 and has an end portion provided with an opening 148. The base 11 of the chair body 10 has a lower end provided with a bottom face 14, and the receiving chamber 141 of the base 11 is formed in the bottom face 14 of the base 11. The seat portion 12 of the chair body 10 is mounted on an upper portion of the base 11. The support shaft 17 of the chair body 10 traverses the bottom face 14 of the base 11. The stand 13 of the chair body 10 is connected with the bottom face 14 of the base 11.

The connecting member 21 is pivotally connected with the base 11 of the chair body 10 and has a first end connected with a lower portion of the back portion 20 and a second end pivotally connected with the support shaft 17 of the chair body 10. The connecting member 21 has a side provided with a mounting hole 211. Preferably, the connecting member 21 is pivotally connected with the back portion 20 by a connecting shaft 213. Alternatively, the connecting member 21 and the back portion 20 are formed integrally.

The restoring device 30 is mounted between the connecting member 21 and the base 11 of the chair body 10 and includes a threaded adjusting sleeve 33 rotatably mounted in the receiving chamber 141 of the base 11, a threaded rod 311 screwed into the adjusting sleeve 33, a pull cord 31 having a first end mounted on the connecting member 21 to move in concert with the connecting member 21 and a second end mounted on the threaded rod 311 to pull the threaded rod 311 and the adjusting sleeve 33 toward the connecting member 21, a catch block 312 secured on the first end of the pull cord 31 and locked onto the mounting hole 211 of the connecting member 21 to attach the first end of the pull cord 31 to the connecting member 21, and an elastic member 32 mounted on the threaded rod 311 and biased between the base 11 of the chair body 10 and the adjusting sleeve 33 to push the threaded rod 311 and the adjusting sleeve 33 outward relative to the connecting member 21.

The threaded rod 311 of the restoring device 30 is extended through the through hole 142 into the receiving chamber 141 of the base 11 and is movable axially in the receiving chamber 141 of the base 11. The elastic member 32 of the restoring device 30 is received in the receiving chamber 141 of the base 11. The pull cord 31 of the restoring device 30 is extended through the through hole 142 into the receiving chamber 141 of the base 11 and is movable in the receiving chamber 141 of the base 11. The pull cord 31 of the restoring device 30 is extended through the mounting hole 211 of the connecting member 21. The adjusting sleeve 33 of the restoring device 30 is movable axially in the receiving chamber 141 of the base 11. The adjusting sleeve 33 of the restoring device 30 has a substantially hexagonal shape and has an inner portion provided with a screw bore 330 screwed onto the threaded rod 311.

In the preferred embodiment of the present invention, the connecting member 21 has a top provided with a plurality of tracks 212, and the seat portion 12 of the chair body 10 has a front end pivotally connected with a front end of the base 11 by a pivot shaft 18 and a rear end provided with a plurality of support rollers 121 mounted in the tracks 212 of the connecting member 21.

The restoring device 30 further includes a washer 313 secured on the first end of the pull cord 31 and located between the mounting hole 211 of the connecting member 21 and the catch block 312 to lock the catch block 312 onto the mounting hole 211 of the connecting member 21 and to enhance the combination strength of the catch block 312 and the pull cord 31, and a spacer 321 mounted on the threaded rod 311 and located between the elastic member 32 and the adjusting sleeve 33 to position the elastic member 32 onto the adjusting sleeve 33. The elastic member 32 of the restoring device 30 surrounds the pull cord 31 and has a first end abutting a peripheral wall defining the through hole 142 of the base 11 and a second end abutting the spacer 321. The spacer 321 of the restoring device 30 abuts the adjusting sleeve 33 and is movably received in the receiving chamber 141 of the base 11.

The base 11 of the chair body 10 is provided with at least one receiving channel 143 to receive the restoring device 30. Preferably, the receiving channel 143 of the base 11 is formed in the bottom face 14 of the base 11 and connected to the receiving chamber 141. The receiving channel 143 of the base 11 has a peripheral wall provided with a first mounting recess 145 for mounting a first guide roller 16 and a second mounting recess 144 for mounting a second guide roller 15, and the pull cord 31 of the restoring device 30 is in turn extended through the mounting hole 211 of the connecting member 21, the first guide roller 16, the second guide roller 15 and the through hole 142 into the receiving chamber 141 of the base 11. Preferably, the pull cord 31 of the restoring device 30 is tensioned between the first guide roller 16 and the second guide roller 15.

Figure 4:
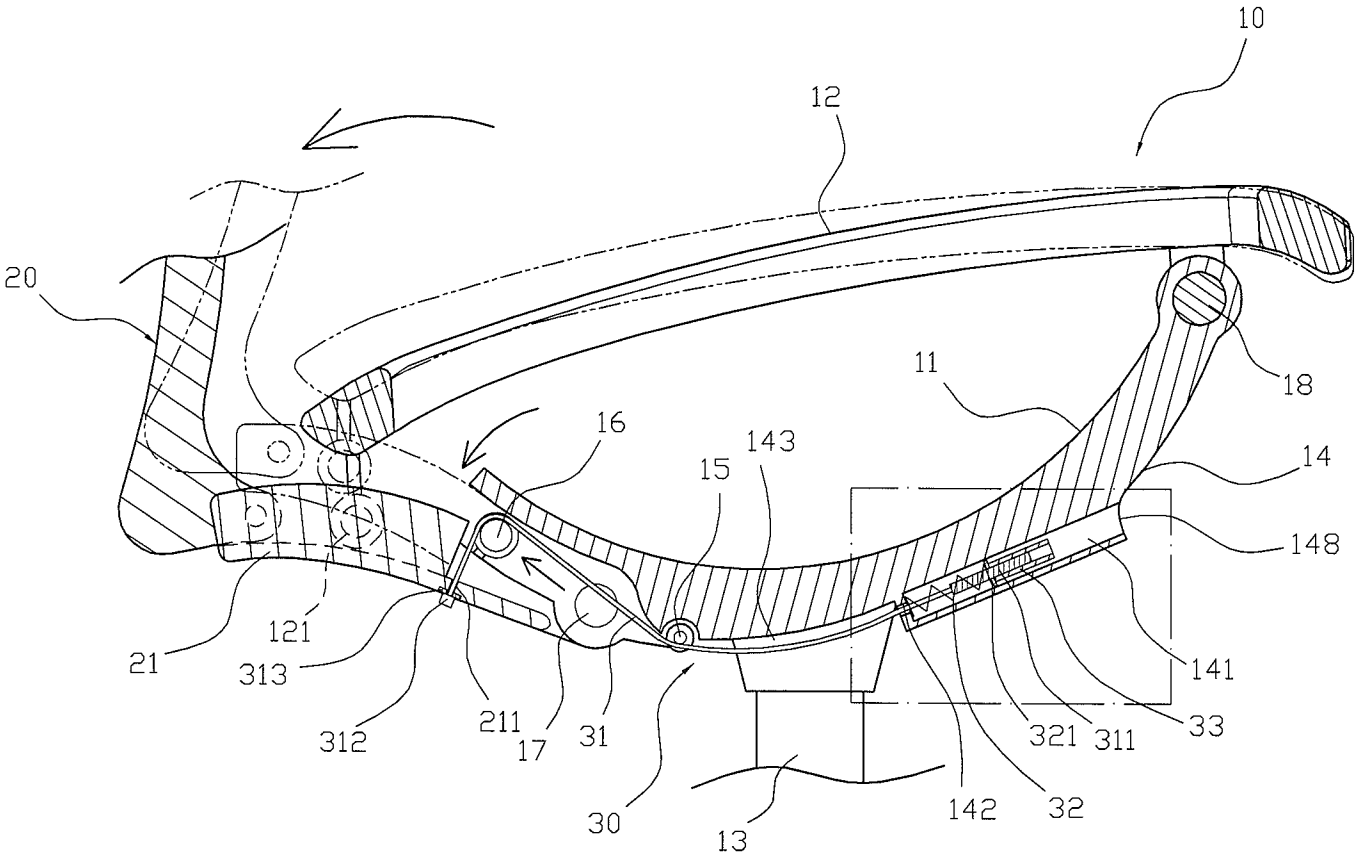
FIG. 4 is a schematic operational view of the chair as shown in FIG. 3 in use.
Figure 5:
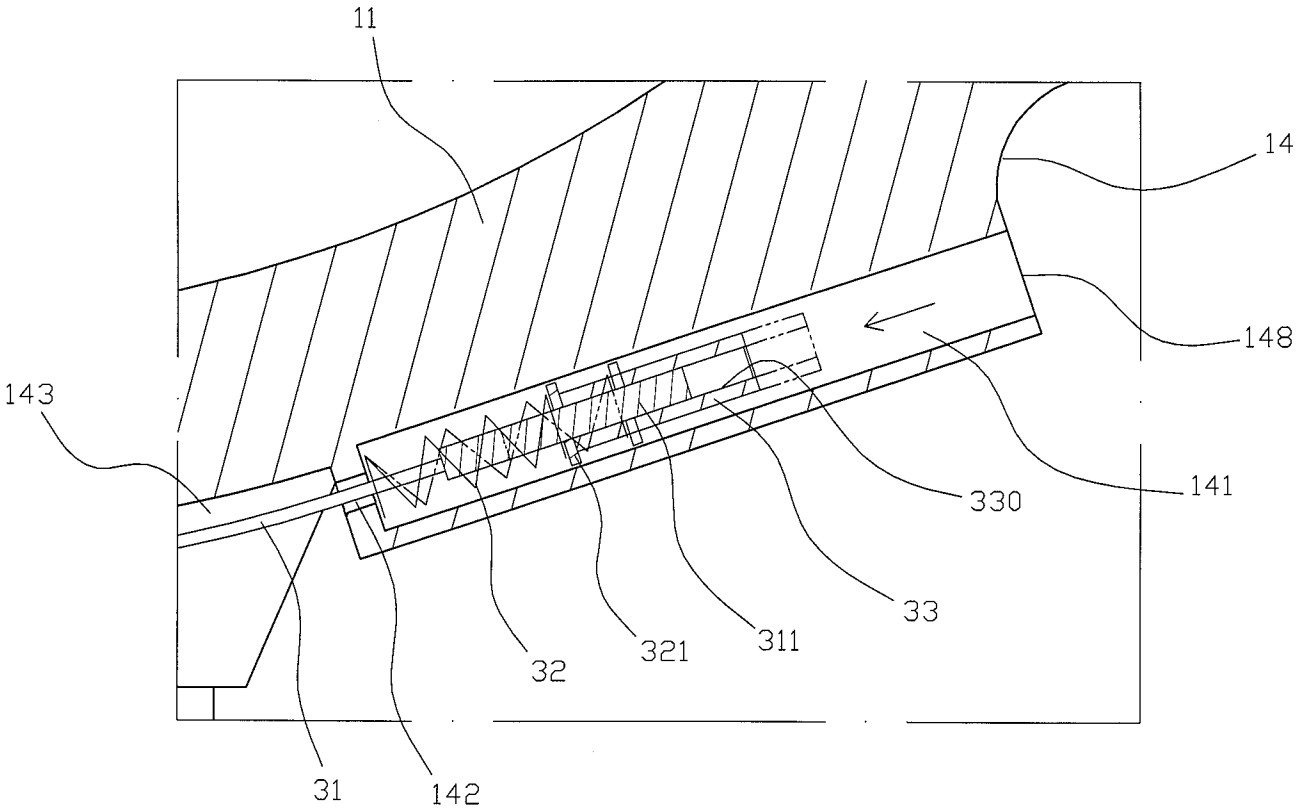
FIG. 5 is a locally enlarged view of the chair as shown in FIG. 4.

In operation, referring to FIGS. 4 and 5 with reference to FIGS. 1-3, when the back portion 20 is pressed by a user's weight, the connecting member 21 is driven by the back portion 20 and is pivoted about the support shaft 17 of the chair body 10 so that the back portion 20 is moved rearward and downward to adjust the inclined angle of the back portion 20 as shown in FIG. 4. At this time, when the connecting member 21 is pivoted, the catch block 312 is moved by the connecting member 21 so that the pull cord 31 is driven by the catch block 312 to pull the threaded rod 311 and the adjusting sleeve 33 toward the elastic member 32 and to compress the elastic member 32 as shown in FIG. 5. In such a manner, the elastic member 32 provides a damping force to damp and stop a further movement of the back portion 20 so as to limit the inclined angle of the back portion 20. On the contrary, when the force applied on the back portion 20 disappears, the pull cord 31 is driven by the restoring force of the elastic member 32 so that the connecting member 21 is moved forward and upward to return the back portion 20 to the original position.

Figure 6:
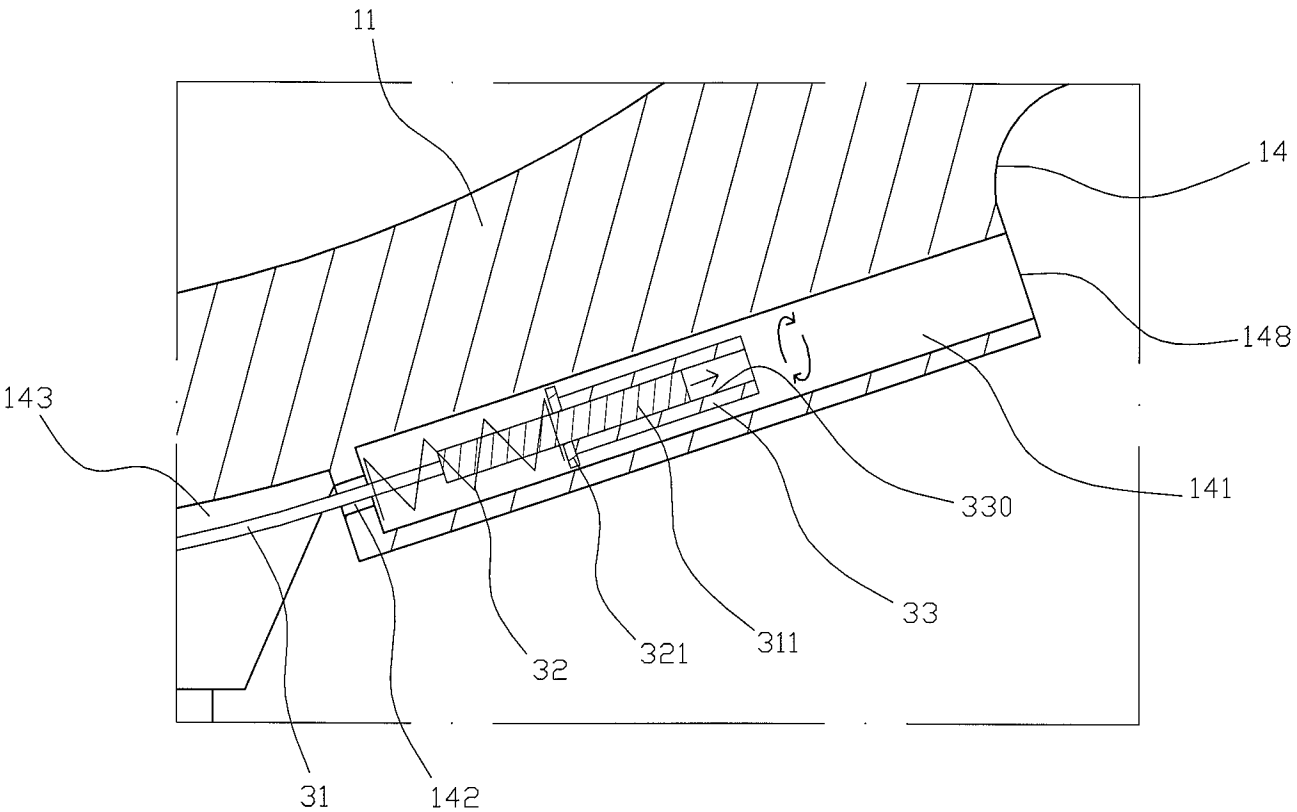
FIG. 6 is a schematic operational view of the chair as shown in FIG. 5.

As shown in FIG. 6, when the elastic member 32 produces an elastic fatigue during a long-term utilization, a hand tool (not shown) is inserted through the opening 148 into the receiving chamber 141 of the base 11 to drive and rotate the adjusting sleeve 33 relative to the threaded rod 311. At this time, the adjusting sleeve 33 is screwed onto the threaded rod 311, while the threaded rod 311 limited by the pull cord 31 so that when the adjusting sleeve 33 is rotated, the adjusting sleeve 33 is moved on the threaded rod 311 toward the elastic member 32 to compress the elastic member 32 so as to increase the tension of the elastic member 32. Alternatively, the adjusting sleeve 33 is moved by the pull cord 31 to protrude outward from the opening 148 of the base 11 so that the user can hold the adjusting sleeve 33 to drive and rotate the adjusting sleeve 33 relative to the threaded rod 311.

Figure 7:
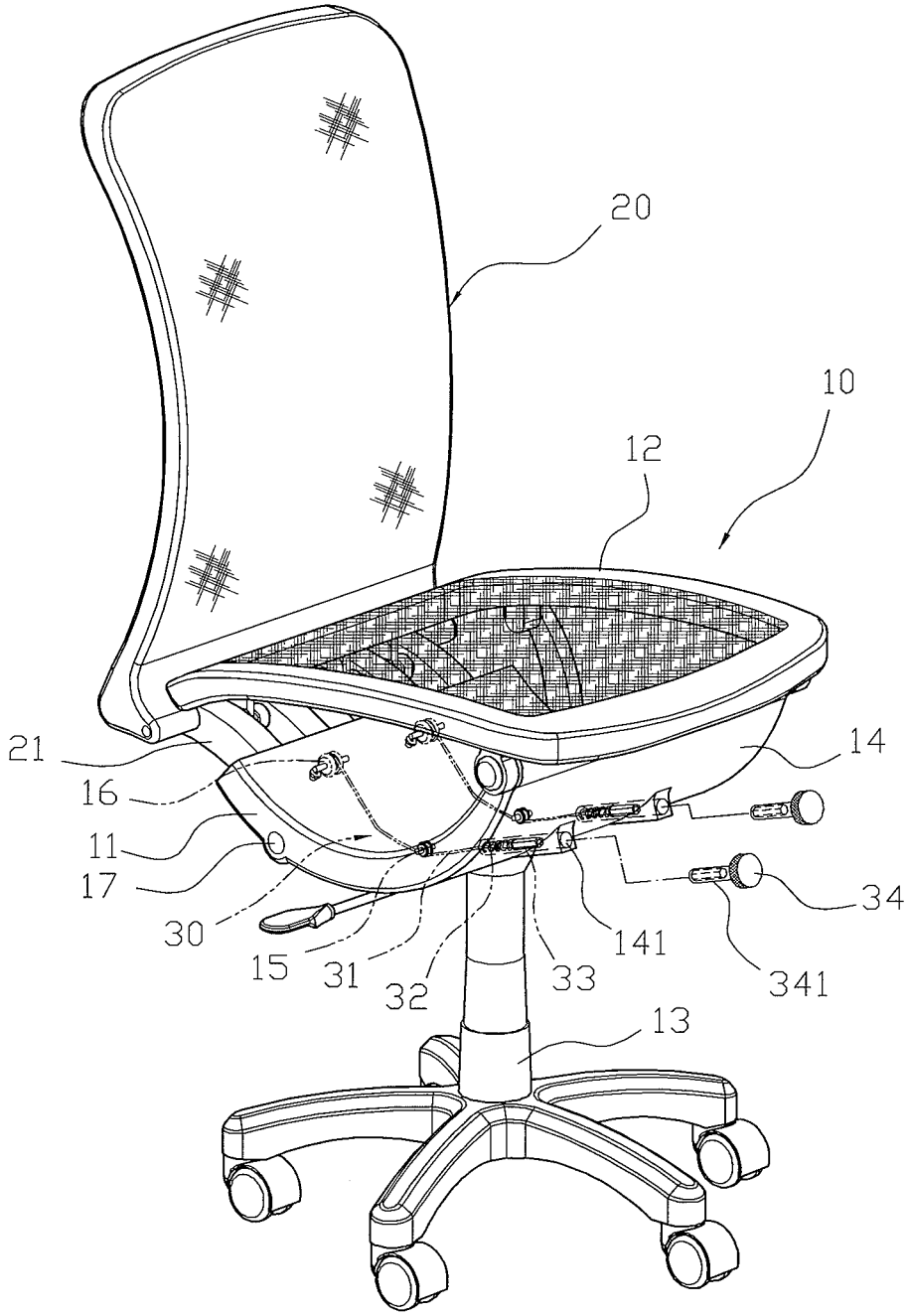
FIG. 7 is a partially exploded perspective view of a chair in accordance with another preferred embodiment of the present invention.

As shown in FIG. 7, the restoring device 30 further includes a rotation knob 34 rotatably mounted on the base 11 of the chair body 10 and having a socket 341 mounted on the adjusting sleeve 33 to drive and rotate the adjusting sleeve 33 relative to the threaded rod 311. Preferably, the rotation knob 34 of the restoring device 30 protrudes outward from the receiving chamber 141 of the base 11, and the socket 341 of the rotation knob 34 is inserted into the receiving chamber 141 of the base 11.

Figure 8:
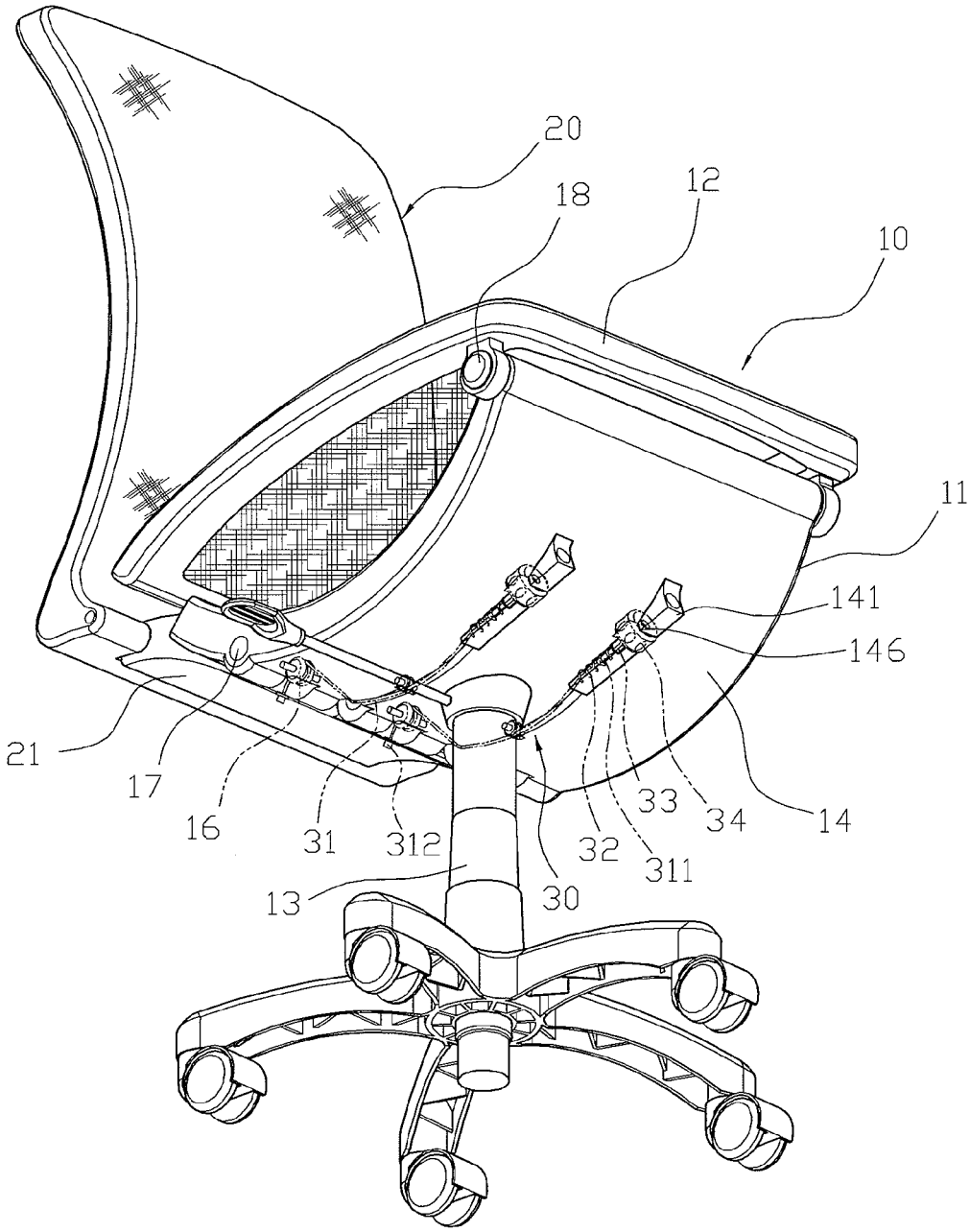
FIG. 8 is a perspective view of a chair in accordance with another preferred embodiment of the present invention.

As shown in FIG. 8, the receiving chamber 141 of the base 11 has a peripheral wall provided with an exposing hole 146, the rotation knob 34 of the restoring device 30 is received in the receiving chamber 141 of the base 11 and is exposed outward from the exposing hole 146 of the base 11.

Figure 9:
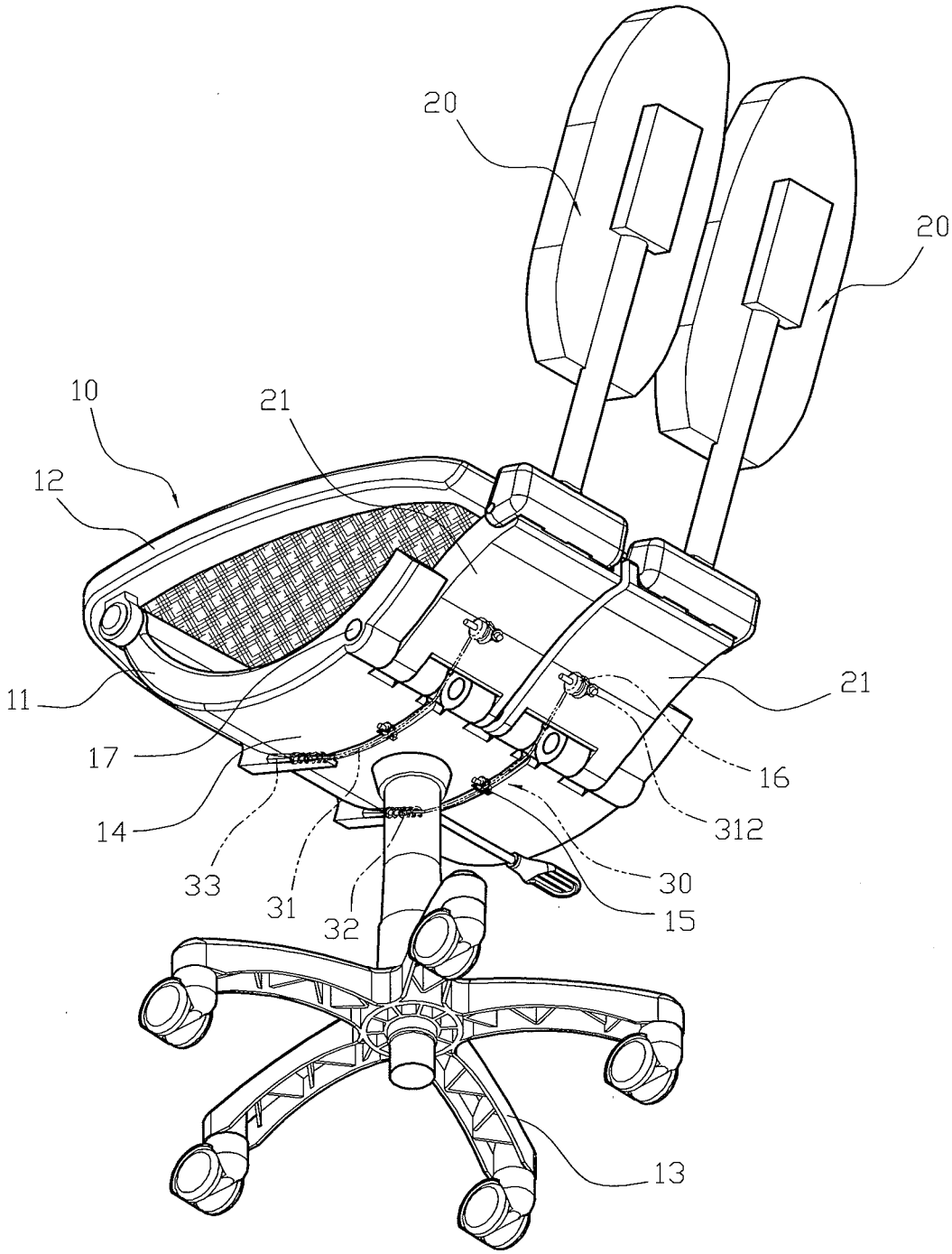
FIG. 9 is a perspective view of a chair in accordance with another preferred embodiment of the present invention.

As shown in FIG. 9, the chair comprises two connecting members 21 each pivotally connected with the base 11 of the chair body 10, two back portions 20 each connected with a respective one of the two connecting members 21, and two restoring devices 30 each mounted between a respective one of the two connecting members 21 and the base 11 of the chair body 10.

Figure 10:
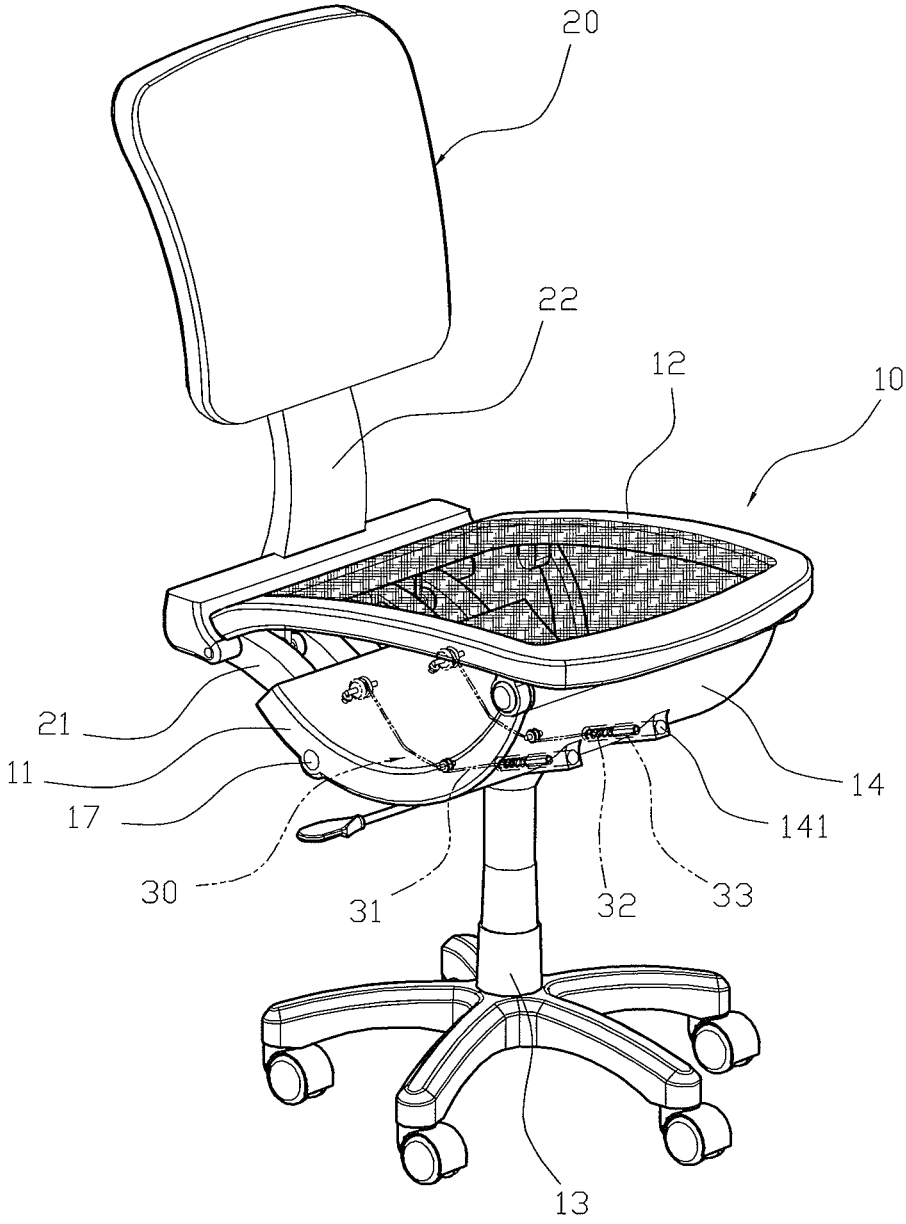
FIG. 10 is a perspective view of a chair in accordance with another preferred embodiment of the present invention.

As shown in FIG. 10, the chair further comprises a support bar 22 mounted between the back portion 20 and the connecting member 21 to connect the back portion 20 with the connecting member 21.

Figure 11:
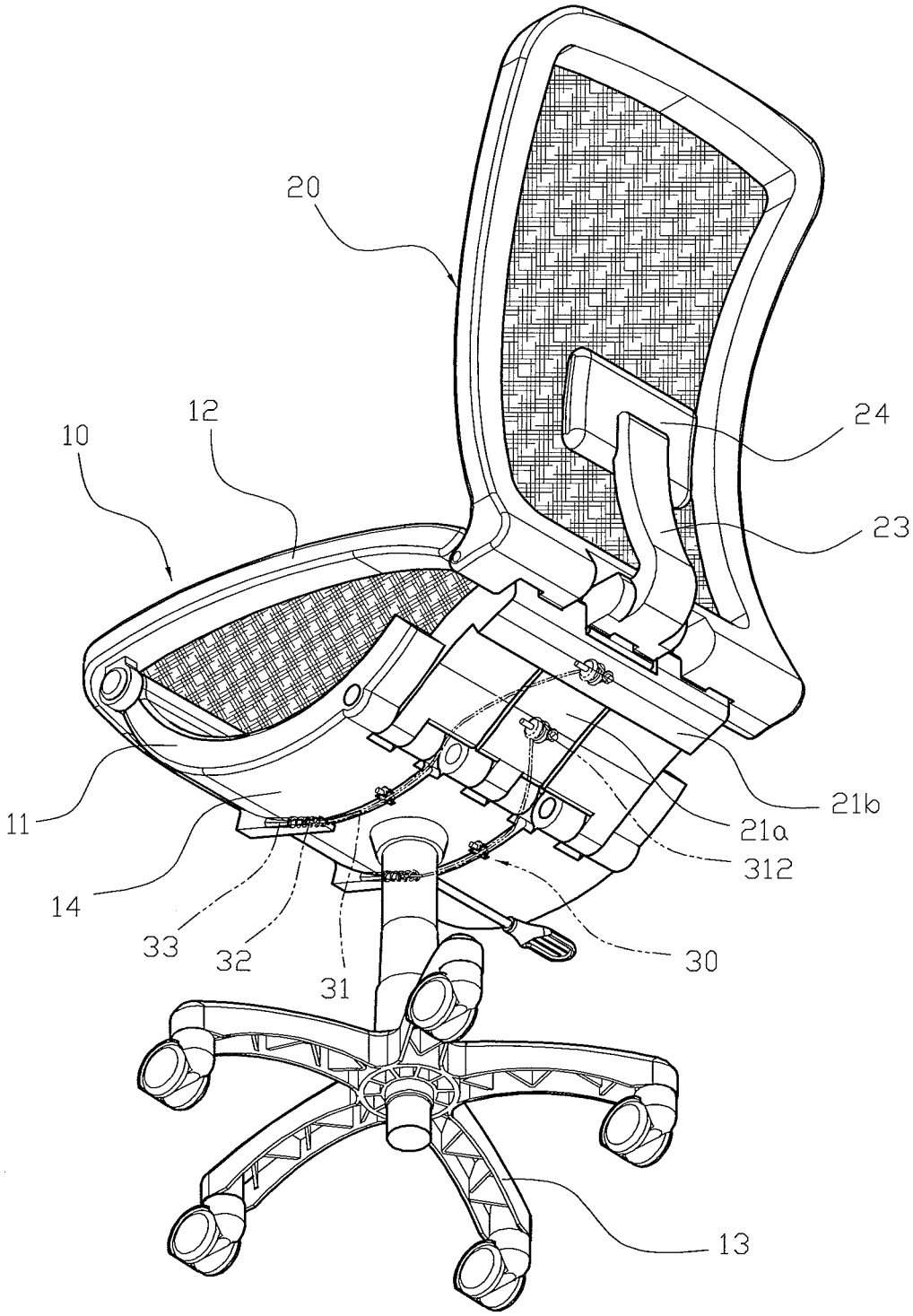
FIG. 11 is a perspective view of a chair in accordance with another preferred embodiment of the present invention.

As shown in FIG. 11, the chair comprises two connecting members 21*a* and 21*b* each pivotally connected with the base 11 of the chair body 10, and a back portion 20 connected with the two connecting members 21*a* and 21*b*. The chair further comprises a support arm 23 having a lower end connected with one of the two connecting members 21*a* and 21*b*, and a waist protection block 24 mounted on an upper end of the support arm 23 and abutting the back portion 20 to protect the user's waist.

Figure 12:
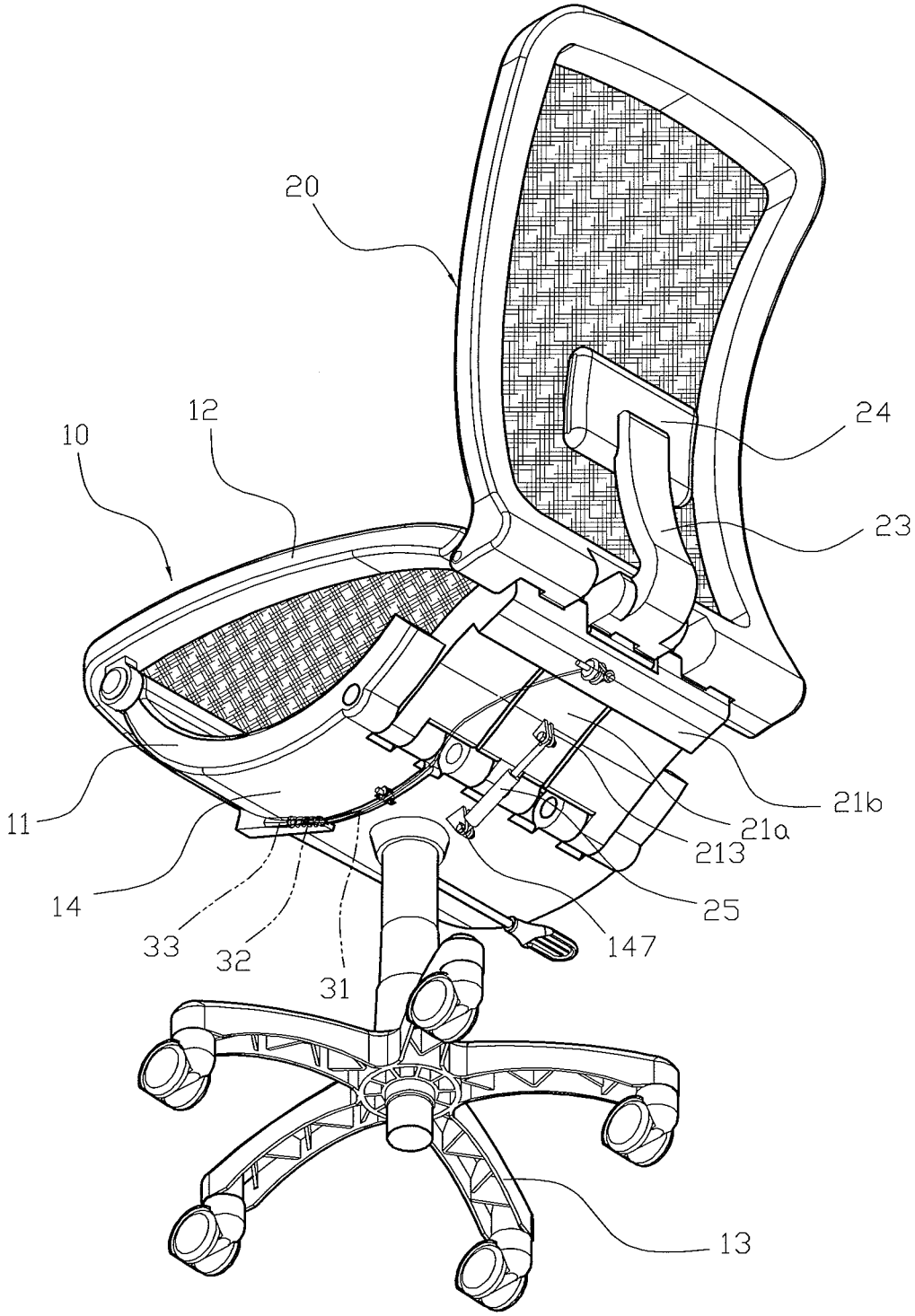
FIG. 12 is a perspective view of a chair in accordance with another preferred embodiment of the present invention.
Figure 13:
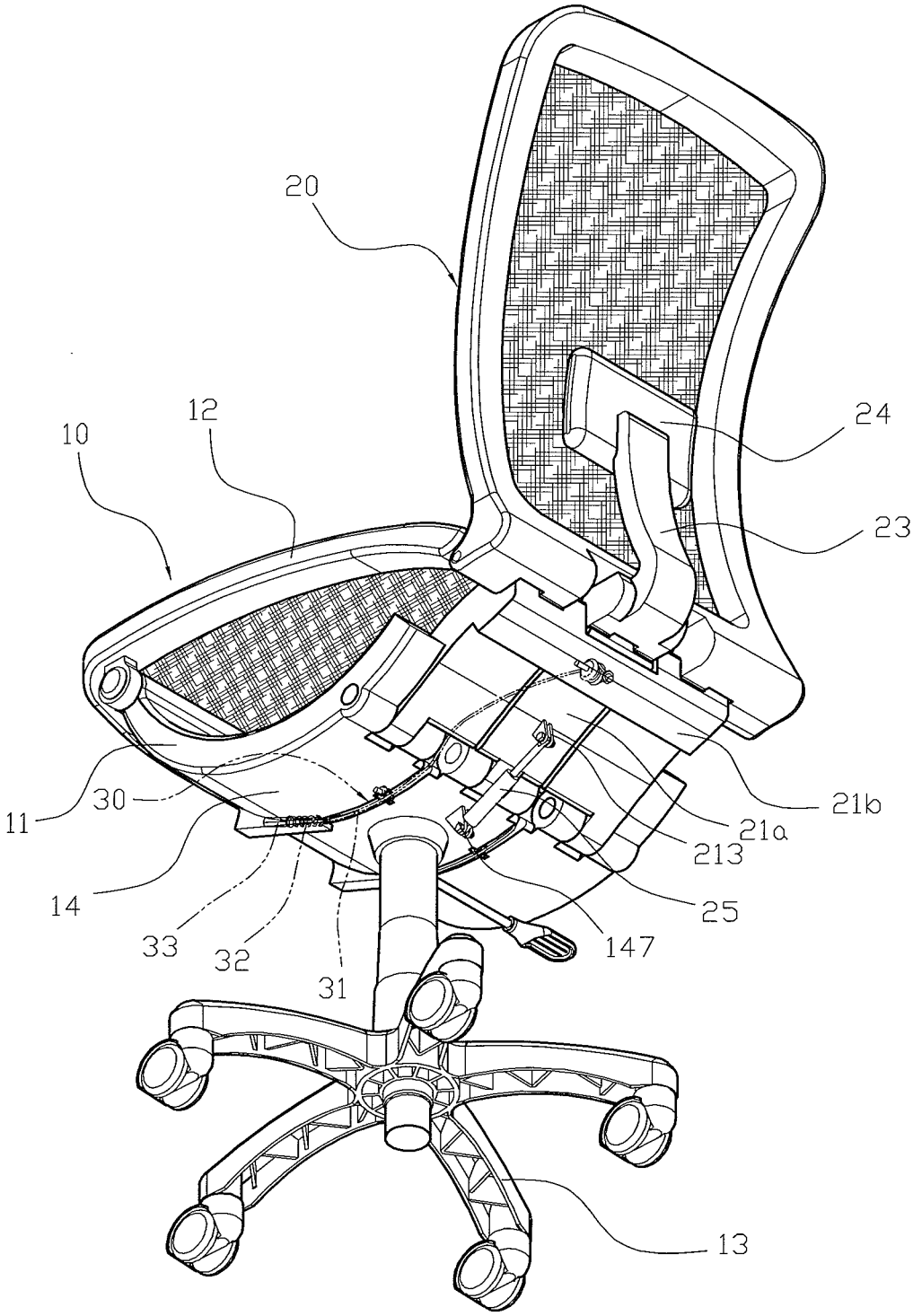
FIG. 13 is a schematic operational view of the chair as shown in FIG. 12.

As shown in FIGS. 12 and 13, the base 11 of the chair body 10 is provided with a first pivot portion 147, one of the two connecting members 21*a* and 21*b* is provided with a second pivot portion 213, and the chair further comprises a hydraulic cylinder unit 25 mounted between the first pivot portion 147 and the second pivot portion 213 to provide a buffering effect between the base 11 of the chair body 10 and one of the two connecting members 21*a* and 21*b*.

Figure 14:
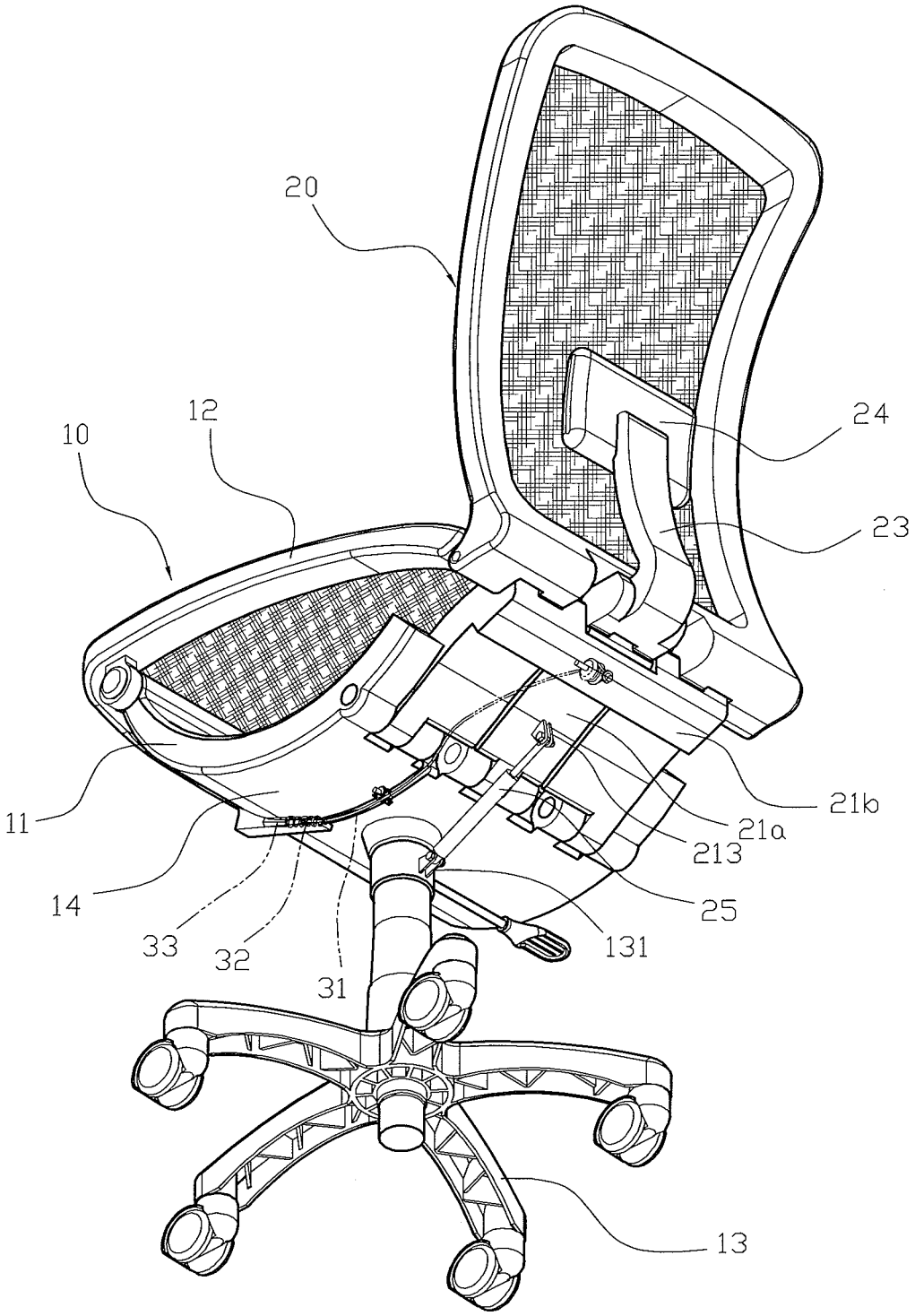
FIG. 14 is a perspective view of a chair in accordance with another preferred embodiment of the present invention.

As shown in FIG. 14, the stand 13 of the chair body 10 is provided with a first pivot portion 131, one of the two connecting members 21*a* and 21*b* is provided with a second pivot portion 213, and the chair further comprises a hydraulic cylinder unit 25 mounted between the first pivot portion 131 and the second pivot portion 213 to provide a buffering effect between the stand 13 of the chair body 10 and one of the two connecting members 21*a* and 21*b*.

Accordingly, when the back portion 20 is pressed by a user's weight, the connecting member 21 is driven by the back portion 20 and is pivoted about the support shaft 17 of the chair body 10 so that the back portion 20 is moved rearward and downward to adjust the inclined angle of the back portion 20 so as to provide a comfortable sensation to the user. In addition, when the connecting member 21 is pivoted, the elastic member 32 provides a damping force to damp and stop a further movement of the back portion 20 so as to limit the inclined angle of the back portion 20. Further, when the force applied on the back portion 20 disappears, the pull cord 31 is driven by the restoring force of the elastic member 32 so that the connecting member 21 is moved forward and upward to return the back portion 20 to the original position. Further, when the elastic member 32 produces an elastic fatigue during a long-term utilization, the adjusting sleeve 33 can be rotated to compress the elastic member 32 so as to increase the tension of the elastic member 32.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A chair, comprising:

a chair body;

at least one connecting member pivotally connected with the chair body;

at least one back portion connected with the connecting member to press and pivot the connecting member outward relative to the chair body; and at least one restoring device mounted between the connecting member and the chair body to pull the connecting member toward the chair body;

wherein the chair body includes a base;

the base of the chair body is provided with at least one receiving chamber to receive the restoring device;

the restoring device includes:

a threaded adjusting sleeve rotatably mounted in the receiving chamber of the base;

a threaded rod screwed into the adjusting sleeve;

a pull cord having a first end mounted on the connecting member to move in concert with the connecting member and a second end mounted on the threaded rod to pull the threaded rod and the adjusting sleeve toward the connecting member; and an elastic member mounted on the threaded rod and biased between the base of the chair body and the adjusting sleeve to push the threaded rod and the adjusting sleeve outward relative to the connecting member.

2. The chair of claim 1, wherein the chair body further includes:

a support shaft mounted on the base and connected with the connecting member;

a seat portion mounted on the base; and a stand mounted on the base;

the receiving chamber of the base has a side provided with a through hole;

the base of the chair body has a lower end provided with a bottom face;

the receiving chamber of the base is formed in the bottom face of the base;

the seat portion of the chair body is mounted on an upper portion of the base;

the support shaft of the chair body traverses the bottom face of the base;

the stand of the chair body is connected with the bottom face of the base;

the connecting member is pivotally connected with the base of the chair body;

the connecting member has a first end connected with a lower portion of the back portion and a second end pivotally connected with the support shaft of the chair body;

the connecting member has a side provided with a mounting hole;

the restoring device is mounted between the connecting member and the base of the chair body;

the restoring device further includes a catch block secured on the first end of the pull cord and locked onto the mounting hole of the connecting member to attach the first end of the pull cord to the connecting member;

the threaded rod of the restoring device is extended through the through hole into the receiving chamber of the base and is movable axially in the receiving chamber of the base.

3. The chair of claim 2, wherein the connecting member has a top provided with a plurality of tracks; and the seat portion of the chair body has a front end pivotally connected with a front end of the base by a pivot shaft and a rear end provided with a plurality of support rollers mounted in the tracks of the connecting member.

4. The chair of claim 2, wherein the restoring device further includes a washer secured on the first end of the pull cord and located between the mounting hole of the connecting member and the catch block to lock the catch block onto the mounting hole of the connecting member.

5. The chair of claim 2, wherein the restoring device further includes a spacer mounted on the threaded rod and located between the elastic member and the adjusting sleeve to position the elastic member onto the adjusting sleeve;

the spacer of the restoring device abuts the adjusting sleeve and is movably received in the receiving chamber of the base;

the elastic member of the restoring device surrounds the pull cord;

the elastic member of the restoring device has a first end abutting a peripheral wall defining the through hole of the base and a second end abutting the spacer.

6. The chair of claim 2, wherein the base of the chair body is provided with at least one receiving channel to receive the restoring device;

the receiving channel of the base is formed in the bottom face of the base and connected to the receiving chamber;

the receiving channel of the base has a peripheral wall provided with a first mounting recess for mounting a first guide roller and a second mounting recess for mounting a second guide roller;

the pull cord of the restoring device is in turn extended through the mounting hole of the connecting member, the first guide roller, the second guide roller and the through hole into the receiving chamber of the base;

the pull cord of the restoring device is tensioned between the first guide roller and the second guide roller.

7. The chair of claim 2, wherein the chair comprises two connecting members each pivotally connected with the base of the chair body, and a back portion connected with the two connecting members;

the chair further comprises:

a support arm having a lower end connected with one of the two connecting members; and a waist protection block mounted on an upper end of the support arm and abutting the back portion.

8. The chair of claim 7, wherein the base of the chair body is provided with a first pivot portion;

one of the two connecting members is provided with a second pivot portion;

the chair further comprises a hydraulic cylinder unit mounted between the first pivot portion and the second pivot portion to provide a buffering effect between the base of the chair body and one of the two connecting members.

9. The chair of claim 7, wherein the stand of the chair body is provided with a first pivot portion;

one of the two connecting members is provided with a second pivot portion;

the chair further comprises a hydraulic cylinder unit mounted between the first pivot portion and the second pivot portion to provide a buffering effect between the stand of the chair body and one of the two connecting members.

10. The chair of claim 2, wherein the elastic member of the restoring device is received in the receiving chamber of the base;

the pull cord of the restoring device is extended through the through hole into the receiving chamber of the base and is movable in the receiving chamber of the base;

the pull cord of the restoring device is extended through the mounting hole of the connecting member;

the adjusting sleeve of the restoring device is movable axially in the receiving chamber of the base.

11. The chair of claim 1, wherein the restoring device further includes a rotation knob rotatably mounted on the base of the chair body and having a socket mounted on the adjusting sleeve to drive and rotate the adjusting sleeve relative to the threaded rod.

12. The chair of claim 11, wherein the rotation knob of the restoring device protrudes outward from the receiving chamber of the base;

the socket of the rotation knob is inserted into the receiving chamber of the base.

13. The chair of claim 11, wherein the receiving chamber of the base has a peripheral wall provided with an exposing hole;

the rotation knob of the restoring device is received in the receiving chamber of the base and is exposed outward from the exposing hole of the base.

14. The chair of claim 1, wherein the chair comprises two connecting members each pivotally connected with the base of the chair body, two back portions each connected with a respective one of the two connecting members, and two restoring devices each mounted between a respective one of the two connecting members and the base of the chair body.

15. The chair of claim 1, wherein the chair further comprises a support bar mounted between the back portion and the connecting member to connect the back portion with the connecting member.

16. The chair of claim 1, wherein the connecting member is pivotally connected with the back portion by a connecting shaft.

17. The chair of claim 1, wherein the adjusting sleeve of the restoring device has a substantially hexagonal shape and has an inner portion provided with a screw bore screwed onto the threaded rod.

18. The chair of claim 1, wherein the receiving chamber of the base has an end portion provided with an opening;

the adjusting sleeve is movable by the pull cord to protrude outward from the opening of the base.

* * * * *